US006026729A

United States Patent [19]

Hallqvist

[11] Patent Number: 6,026,729

[45] Date of Patent: Feb. 22, 2000

[54] METHOD AND DEVICE FOR HANDLING PROPELLANT CHARGES

[75] Inventor: Sten Hallqvist, Vingåker, Sweden

[73] Assignee: Bofors AB, Karlskoga, Sweden

[21] Appl. No.: 09/068,530

[22] PCT Filed: Dec. 1, 1997

[86] PCT No.: PCT/SE97/02008

§ 371 Date: Sep. 11, 1998

§ 102(e) Date: Sep. 11, 1998

[87] PCT Pub. No.: WO98/25096

PCT Pub. Date: Jun. 11, 1998

[30] Foreign Application Priority Data

Dec. 2, 1996 [SE] Sweden ..... 9604422

[51] Int. Cl.[7] ..... F41A 9/11; F41A 9/13; F41A 9/16

[52] U.S. Cl. ..... 89/46; 89/47

[58] Field of Search ..... 89/45, 46, 47

[56] References Cited

U.S. PATENT DOCUMENTS

| | | | |
|---|---|---|---|
| 4,648,305 | 3/1987 | Elspass | 89/45 |
| 4,819,518 | 4/1989 | Pahnke | 89/46 |
| 5,111,730 | 5/1992 | Grabner | 89/45 |
| 5,111,731 | 5/1992 | Grabner | 89/46 |
| 5,267,503 | 12/1993 | Grabner | 89/46 |
| 5,289,754 | 3/1994 | Elspass | 89/46 |
| 5,526,730 | 6/1996 | Zangrando | 89/34 |
| 5,728,966 | 3/1998 | Bobinger et al. | 89/46 |

FOREIGN PATENT DOCUMENTS

| | | | |
|---|---|---|---|
| 3642920 | 6/1988 | Germany | 89/46 |
| 3903671 | 8/1990 | Germany . | |
| 3294793 | 12/1991 | Japan | 89/47 |
| 1251176 | 10/1971 | United Kingdom . | |
| 1490112 | 10/1977 | United Kingdom | 89/47 |

OTHER PUBLICATIONS

K.C. Pan, Applications of Robotics and Artifical Intelligence to Armament, Army Research, Development and Acquisition Magazine, Oct. 1983, pp. 15–17, 89/45.

*Primary Examiner*—Stephen M. Johnson
*Attorney, Agent, or Firm*—Pollock, Vande Sande & Amernick

[57] ABSTRACT

The present invention relates to a method and a device for artillery guns with fully or semi-automatic loading systems for stowing, handling and, prior to loading the gun in question, for preparing complete propellant charges consisting of modular charges of M(A)CS type, i.e. such complete charges that consist of a number of mutually combinable modular charges which, as they may contain different types of propellant and may be of different standardized lengths can be of different strengths, and which all have a primarily rigid combustible outer casing and where each one incorporates the necessary ignition system. As claimed in the present invention each modular charge is stowed linearly after the other in magazine tubes (4) arranged compactly in parallel on top of and beside each other, each one containing a number of a modular charges of a specific type. A pre-determined number of modular charges can then be retrieved from any freely elective magazine tube by a designated manipulator (7–10, 23, 35) that can retrieve modular charges from any commanded magazine tube (4). The manipulator subsequently deposits the modular charges into the loading tray or loading pendulum (11, 27, 42).

45 Claims, 4 Drawing Sheets

METHOD AND DEVICE FOR HANDLING PROPELLANT CHARGES

FIELD OF THE INVENTION

The present invention relates to a method and a device for stowing and handling modular type propellant charges in artillery guns with fully or semi-automatic loading systems.

BACKGROUND OF THE INVENTION

It is already possible using artillery locating radar and other surveillance systems, for example, to determine rapidly and with high precision the location of an artillery gun that has opened fire. There is thus a good opportunity for an enemy to open effective counter-battery fire. The artillery has therefore more or less been forced to depart from its previously fairly stationary tactics in favour of significantly more mobile tactics involving rapid engagements in the form of short intensive fires followed by immediate redeployment to a pre-determined deployment site at a sufficiently safe distance from the previous one. These new tactics have resulted in an increased need for every gun to be self-propelled and capable of carrying at least a primary requirement of ammunition.

One must also assume that coming generations of artillery will use modular type propellant charges, that is, propellant charges consisting of a number of modular charges of different sizes, such as length and, to a certain extent, diameter, of different charge strength with primarily rigid combustible outer casings, and that are combinable in various ways to provide the desired muzzle velocities. At present this system of modular charges is called M(A)CS, that is, Modular (Artillery) Charge System. Moreover, as the next generation of artillery guns is expected to be equipped with armoured protection against battlefield fragments to an even greater extent than is normal today. Next generation loading systems will be required to operate very rapidly and be capable of stowing large quantities of propellant charges and of handling all the different types of propellant charges in the M(A)CS. The propellant charges must also be stowable in the least possible space. In addition, loading systems shall be robust and durable, and the propellant charge magazine shall be replenishable in a very short time, preferably from a vehicle equipped with an automatic resupply unit.

SUMMARY OF THE INVENTION

The purpose of the present invention is to offer a propellant charge handling system that meets the above stated requirements.

The invention is based on the use of a very compact stowage space in which the modular charges are stowed linearly in a number of parallel magazine tubes. Each magazine tube contains modular charges of a single type. Each magazine tube terminates in a common endplane while the opposite end of each magazine tube is accessible for an ejector provisionally built into the tube. Even ejectors operated by compressed air ought to be usable.

In combination with this magazine a manipulator is used that can be described as an industrial robot with limited operating motion arranged to manoeuvre a retrieval tube between the outfeed apertures of the magazine tubes. The retrieval tube is thus aligned with a magazine tube after which the desired number of modular charges are transferred to the retrieval tube. This arrangement can thus retrieve modular charges from a number of different magazine tubes and, thereby, assemble a complete propellant charge of the desired charge strength before it is manoeuvred to an outer end position aligned with the loading pendulum used to load the artillery gun in question and to which the complete charge is transferred by, for example, an ejector built into the retrieval tube. The latter can also be used to determine the number of modular charges to be retrieved from a specific magazine tube.

A special variant of the present invention would be to use two identically designed compact magazines and arrange a retrieval tube in a space between them, i.e. to enable it to retrieve modular charges from both its ends. In this variant, the retrieval tube should also be usable for transferring modular charges to the loading pendulum, or be usable itself as a loading pendulum for loading the gun. However, in this version the ejector must be specially designed so that it is not in the way when replenishing with modular charges via the rear aperture of the retrieval tube.

BRIEF DESCRIPTION OF THE DRAWINGS

The method and device according to the present invention shall now be described in further detail with reference to the appended figures in which.

Figure 1:
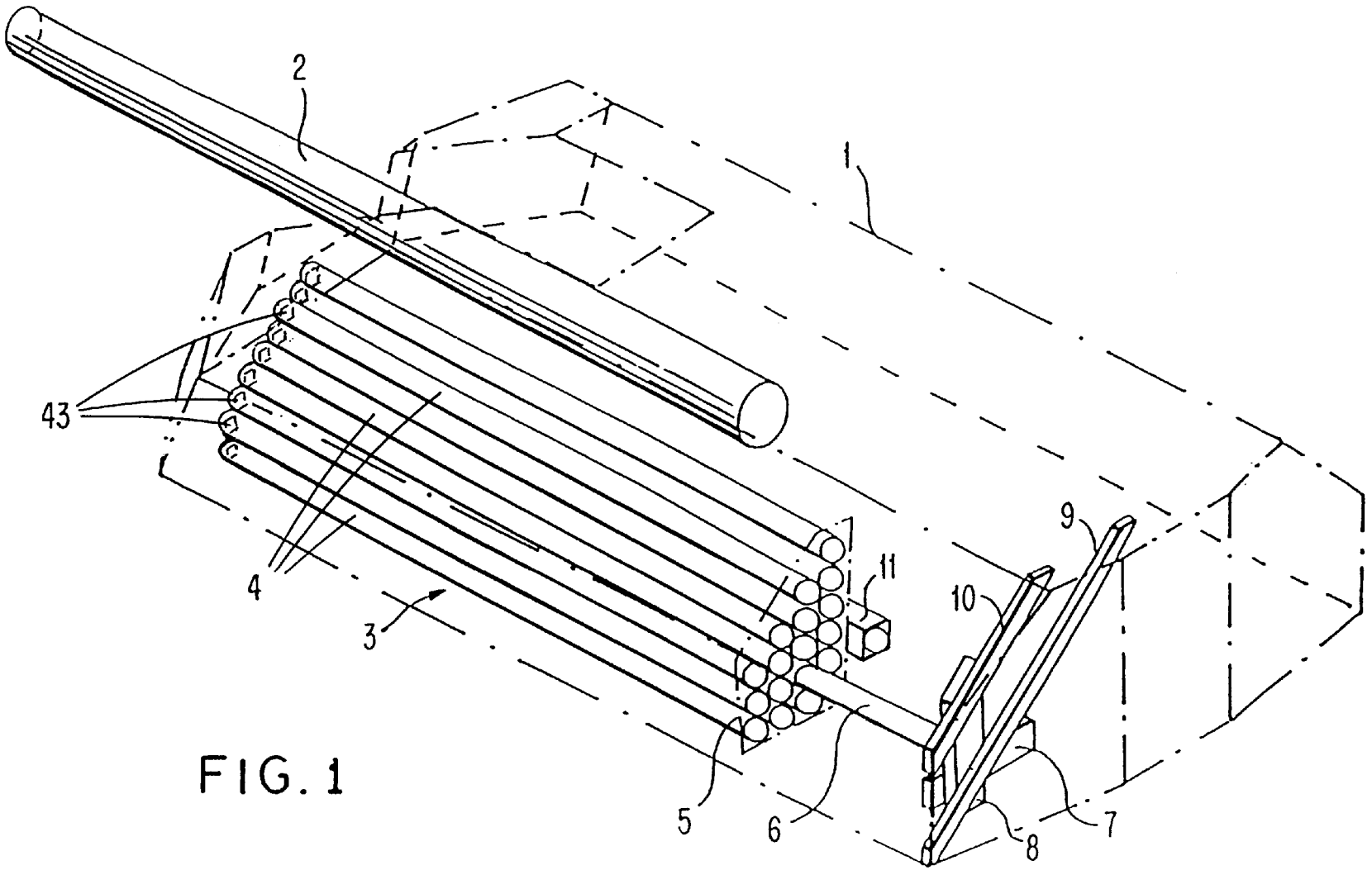
FIG. 1 shows an exploded perceptive partial cut-away view of an artillery gun mounted in an armoured turret.
Figure 2:
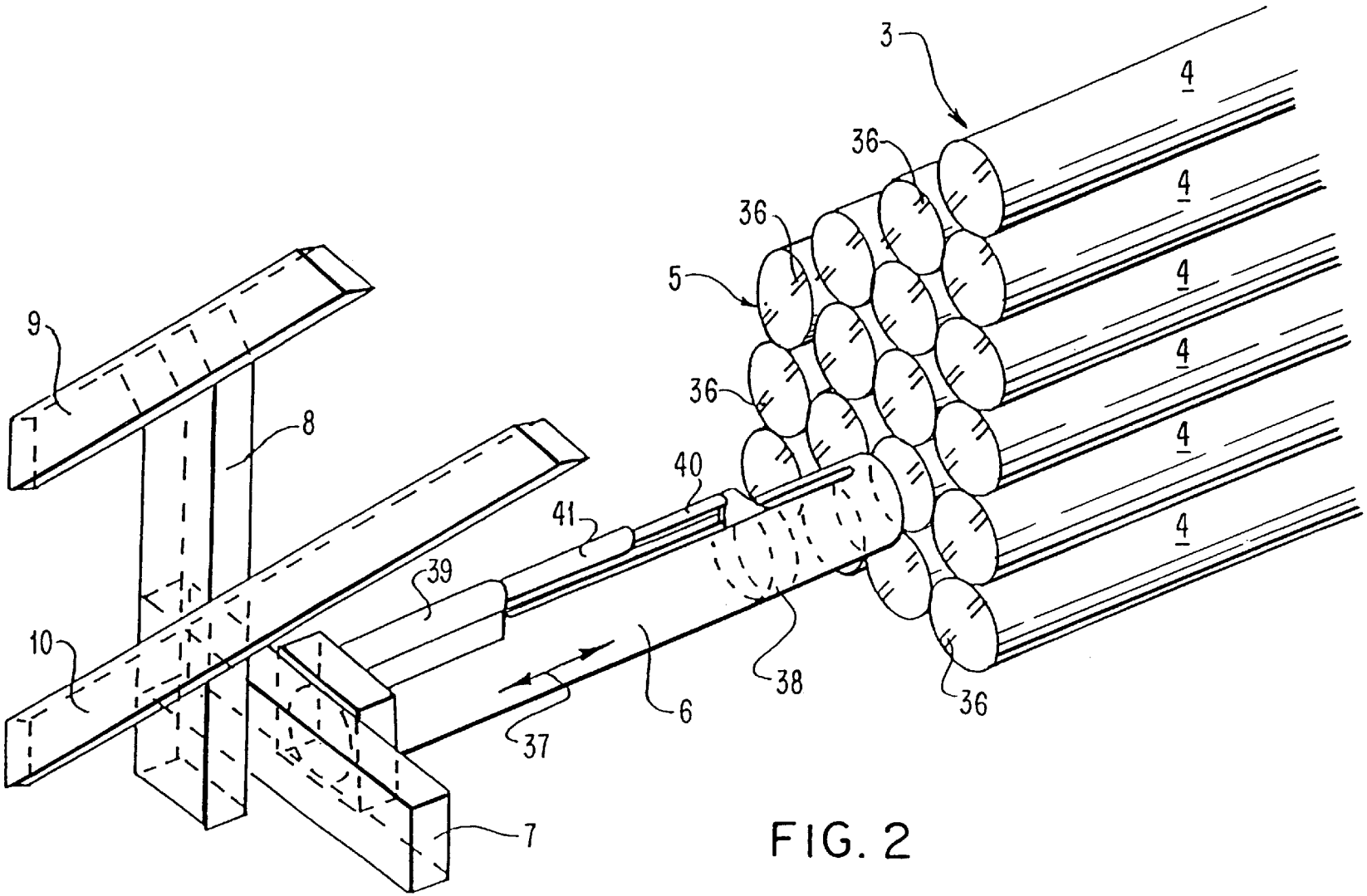
FIG. 2 shows a subassembly from FIG. 1 to a larger scale.

Parts shown on more than one figure, primarily FIGS. 1 and 2 and partially 4, have the same designation irrespective of scale.

DETAILED DESCRIPTION OF THE INVENTION

Figure 4:
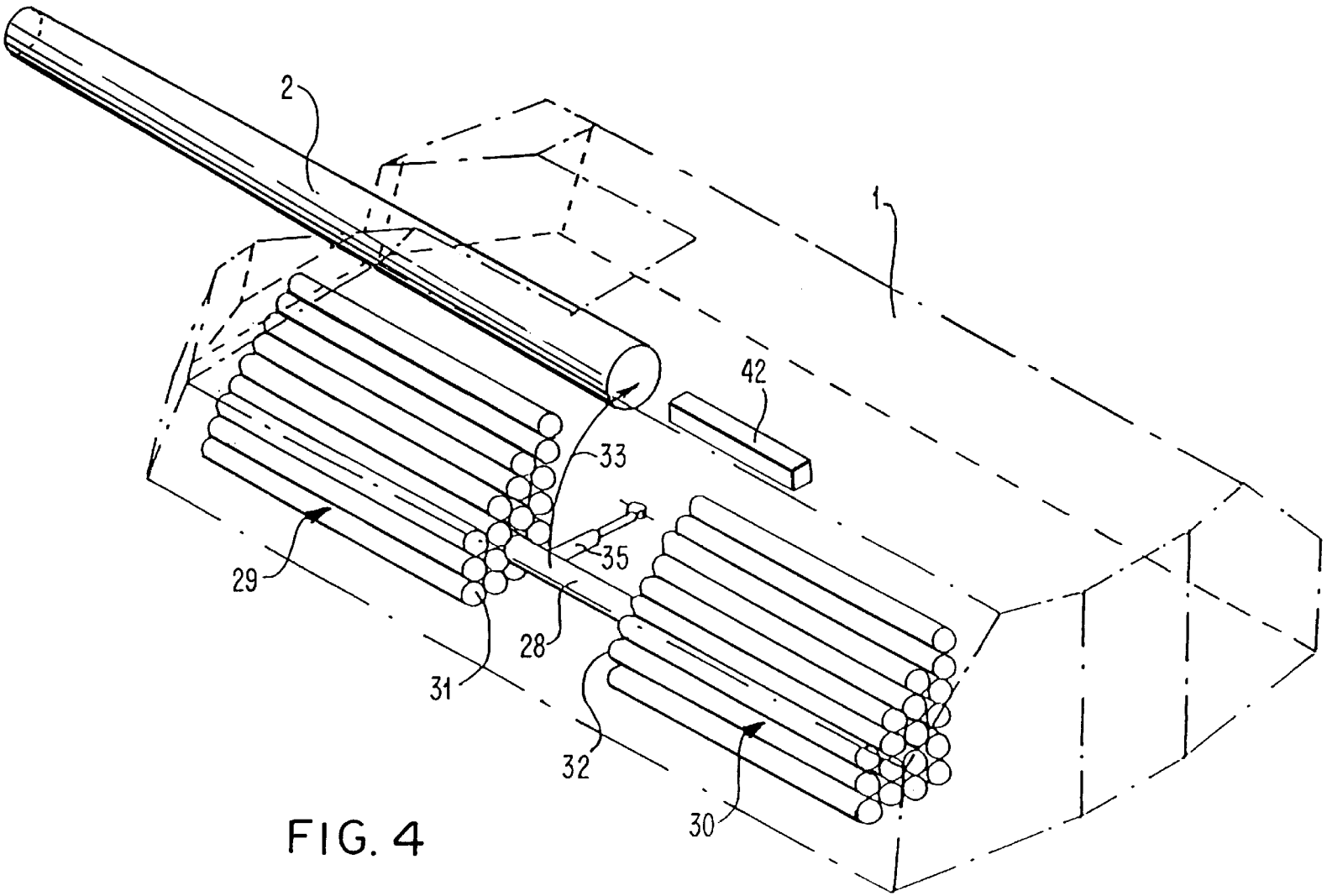
FIG. 4 shows the same exploded perspective partial cut-away view as that shown in FIG. 1 but with a propellant magazine divided into two sections.

FIGS. 1 and 4 show the outer contours of an artillery gun 2 mounted in an armoured turret 1. All parts relating to the mounting of the gun, loading trays, rammer, and the complete projectile handling system have been excluded from the figures for the sake of clarity.

In the armoured turret 1 there is a compact modular charge magazine 3 consisting of eighteen magazine tubes in the example illustrated arranged on top of and beside each other. All the magazine tubes terminate in one and the same vertical endplane 5. Each of the magazine tubes 4 has its outfeed aperture in this endplane. Each such outfeed aperture may, if so desired, be equipped with an openable and closable protective cap or catch (no suchlike, however, is illustrated in the figure). Each magazine tube is also accessible from the opposite end to the outfeed aperture for an ejector operating in each magazine tube. This ejector may be mechanically driven by compressed air or another medium. As each ejector is conceived as being located inside each magazine tube, as ejectors 43 illustrated in the FIG. 1. The same type of propellant charge of modular type shall be stowed in each magazine tube 4. These modular charges have combustible outer casings with an external shape enabling them to be mutually combinable. Since the changes may be of different charge strengths and lengths, by assembling an appropriate combination of various such modular charges a complete charge of exactly the strength desired can be obtained.

For retrieving modular charges from one or more predetermined magazine tubes there is a retrieval tube 6 parallel to the magazine tubes and indexable between their outfeed apertures. In the version illustrated in FIGS. 1 and 2 the retrieval tube 6 is mounted on a horizontal mechanically drivable lateral feed slide 7 which in turn is mounted on a mechanically drivable vertical feed slide 8. The latter is in turn mechanically drivable along two diagonal guides 9 and 10.

By means of the horizontal, lateral, and diagonal drives the retrieval tube 6 can access all the magazine tubes including those that are close to the sloping side roof of the armoured turret. The retrieval tube 6 has one more position, namely immediately behind the loading pendulum 11 via which the artillery gun 2 is finally loaded. For transfer of the modular charges retrieved from the magazine tubes from the retrieval tube 6 to the loading pendulum there is an ejector fully integrated in the retrieval tube 6.

Each magazine tube must be equipped with an outfeed catch of some type or other to retain the modular charges in the magazine tubes when the gun is in transport mode but which can be deactivated when one or more modular charges shall be retrieved. The outfeed catches may be of elementary technical design which is why they are only generally indicated in FIG. 2 where they are designated 36.

For deactivating these outfeed catches when retrieving modular charges, the retrieval tube 6 may, for example, be designed to have limited axial movement indicated by arrow 37 to enable the retrieval tube to connect snugly with the outfeed aperture of the relevant magazine tube on each occasion.

At the same time the outfeed catches 36 are designed in such a way that they automatically retract to the side of any magazine tube when the retrieval tube 6 connects with the outfeed aperture of the magazine tube in question. When retrieval is complete the outfeed catches 36 return to closed position when the retrieval tube 6 disconnects from the outfeed aperture of the magazine tube.

The retrieval tube 6 may also be fitted with an internal blocking device such as a feed stop that can be indexed between a number of different positions, each of which leaves the internal length in the retrieval tube free that corresponds to the number of modular charges that are to be retrieved on each occasion from each magazine tube. Such an indexable internal feed stop 38 (see FIG. 2) may also be used as an ejector for transferring the modular charges retrieved into the loading tray of the gun. For indexing the feed stop 38 there is an extendible/retractable hydraulic piston system 39 as illustrated in FIG. 2 comprising three slidable pistons of which two (40, 41) in the position shown in the figure are maximally extended and the third is fully retracted.

Figure 3:
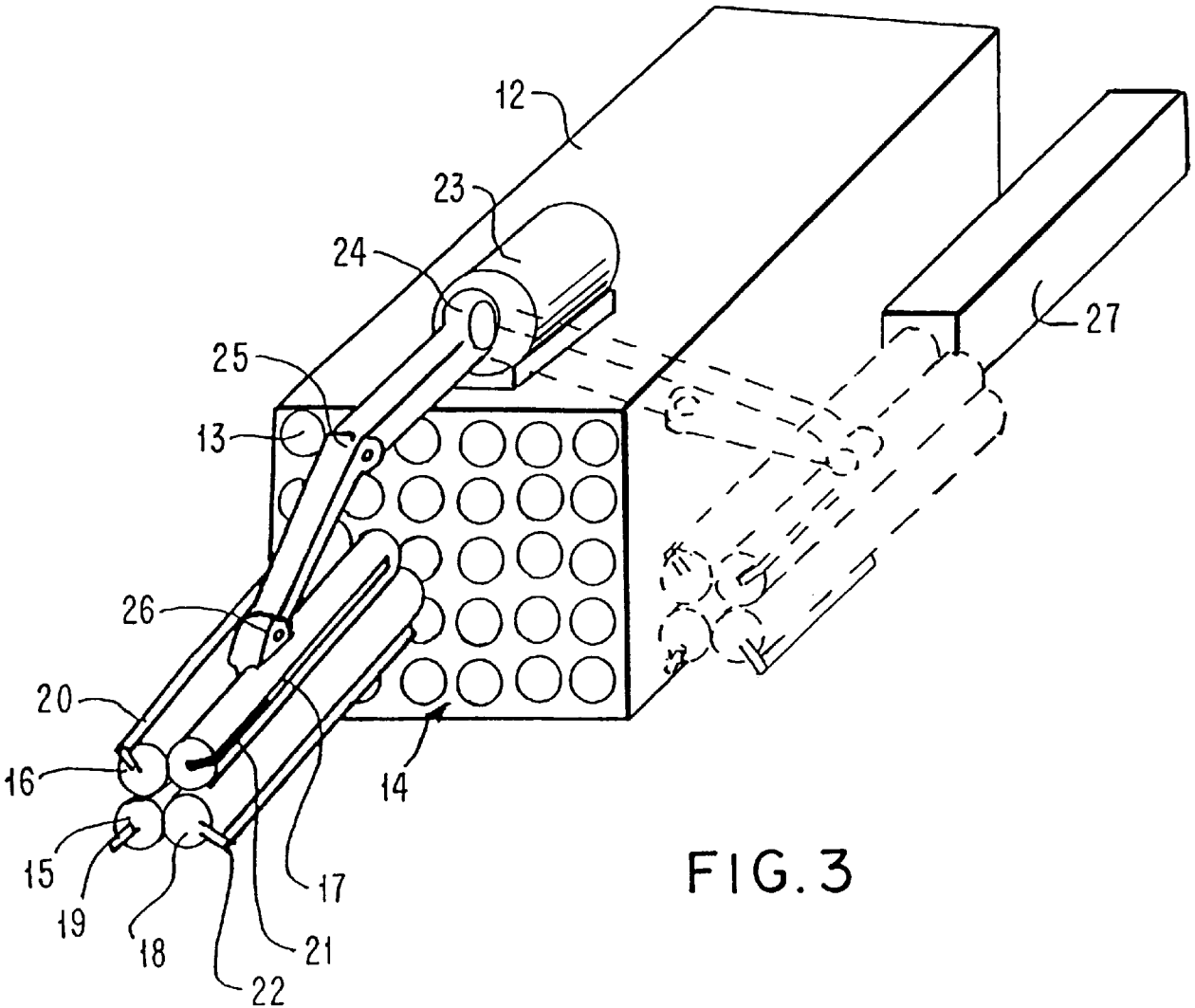
FIG. 3 shows a perspective view of a diagonal sectional view of a variant of the device according to the present invention.

FIG. 3 shows another version providing greater manoeuvrability to the retrieval tube.

This version uses a compact magazine 12 consisting of parallel magazine tubes 13 arranged on top of and beside each other, all terminating in one endplane 14 where they have their outfeed apertures. All the magazine tubes are equipped with ejectors at the opposite end to the outfeed aperture. The magazine tubes shall have some kind of retaining catch at each end.

Instead of one retrieval tube this example uses four such retrieval tubes 15–18, each of which is equipped with a chain-driven ejector 19–22 as indicated in the figure. Retrieval tubes 15–18 are in turn mounted on a journalled arm 24, an elbow 25, and a wrist 26-mounted manipulator 23. By means of this manipulator 23 any of the retrieval tubes 15–18 can be positioned in front of any elective magazine tube 13 from which it can retrieve the desired number of modular charges. By repeating this sequence with all four retrieval tubes for the elective magazine tubes, four complete propellant charges can be kept in readiness.

From the position with the retrieval tubes immediately outside the outfeed apertures of the magazine tubes, the manipulator 23—thanks to its three journalled joints which, if required, can be provided with full swivel and slewing mobility—can swing the retrieval tubes directly behind the loading pendulum 27 provided for loading the artillery gun, in which position the relevant ejectors 19–22 are actuated.

Thus, with this version complete propellant charges for four rounds are always available for firing in extremely rapid sequence without the retrieval tubes needing to return to the magazine tubes for replenishment. If desired, for continuous fire only one retrieval tube needs to be replenished at a time as this would enable a more even rate of fire.

Finally, FIG. 4 shows a variant in which the propellant magazine is divided into a forward unit 29 and an aft unit 30. Both these magazines are constructed of the same sort of magazine tubes as in the previous magazine. However, they have their respective outfeed apertures 31 and 32 facing each other. As in previous versions the ejectors are built into the magazine tubes.

In this connection it may be relevant to point out that the number of modular charges fed out from a magazine tube into a retrieval tube on each single occasion can either be determined by precisely defining the length of stroke of the ejector and the ejection velocity, or by making the outfeed ejector built into the retrieval tube adjustable according to the number of modular charges the retrieval tube shall be permitted to receive on each occasion, i.e. in general as claimed in what has already been stated concerning the device shown in FIG. 2.

In the version illustrated in FIG. 4 the retrieval tube 28 is arranged to pivot between the two propellant magazines 29 and 30, and from freely elective retrieval positions can receive modular charges from each magazine both from the front and rear. Furthermore, the retrieval tube can pivot through arc 33 to a position directly behind the breech opening of the gun and thereby also function as a loading tray and rammer. Unless the retrieval tube is provided with a special angle-setting capability, however, the above can only be performed when the gun is at zero degrees elevation. Consequently, in most cases a loading pendulum 42 is required as an intermediate stage.

To enable the retrieval tube to reach all the magazine tubes as well as the correct position behind the breech opening of the gun 2 it is presupposed that the pivot arms 34 and 35, of which only 35 is visible in the figure, are of continuously adjustable length.

When replenishing magazines of the above types new modular charges are furnished by special resupply vehicles that feed in the new modular charges via purpose made hatches after which the new modular charges are distributed to the individual magazine tubes by the retrieval tube(s).

We hereby claim and desire to secure by Letters Patent the following:

1. A method for assembling complete propellant charges from a plurality of modular propellant charges, the method comprising:

stowing the modular charges in a plurality of magazine tubes;

arranging at least one retrieval tube in the vicinity of an outfeed aperture of at least one of the magazine tube;

moving a plurality of the modular charges from at least one of the magazine tubes into the at least one retrieval tube;

arranging the at least one retrieval tube in the vicinity of a loading mechanism of an artillery gun; and transferring the modular charges from the at least one retrieval tube to the loading mechanism.

2. The method according to claim 1, wherein the magazine tubes are all arranged parallel to each other.

3. The method according to claim 2, wherein each magazine tube is arranged adjacent at least one other magazine tube.

4. The method according to claim 2, wherein all of the magazine tubes terminate in a common end plane.

5. The method according to claim 1, wherein the loading mechanism automatically loads the modular charges into a barrel of the artillery gun.

6. The method according to claim 1, wherein the loading mechanism semi-automatically loads the modular charges into a barrel of the artillery gun.

7. The method according to claim 1, wherein the modular charges are modular artillery charges.

8. The method according to claim 1, wherein some of the modular charges have different characteristics than other of the modular charges wherein the characteristics include at least one member selected from the group consisting of different types of propellant, lengths, diameters and strengths.

9. The method according to claim 8, wherein a muzzle velocity of the artillery gun may be varied by varying the number and characteristics of the modular charges retrieved from the magazine tubes.

10. The method according to claim 1, wherein the modular charges include a substantially rigid combustible outer casing.

11. The method according to claim 1, wherein the modular charges are linearly stored in the magazine tubes.

12. The method according to claim 1, wherein the at least one retrieval tube is arranged utilizing a manipulator.

13. The method according to claim 1, wherein the plurality of modular charges are moved into the at least one retrieval tube from the plurality of magazine tubes, and the position of the at least one retrieval tube is altered in stages to be arranged in the vicinity of the plurality of magazine tubes.

14. The method according to claim 1, wherein the loading mechanism comprises a loading tray and a loading pendulum.

15. A device for assembling complete propellant charges from a plurality of modular propellant charges, comprising:

a plurality of magazine tubes each for receiving a plurality of modular charges, each magazine tube having an outfeed aperture;

a plurality ejectors for ejecting the modular charges from the magazine tubes;

at least one retrieval tube for receiving the modular charges from the magazine tubes; and a manipulator for altering a position of the at least one retrieval tube adjacent any of the magazine tubes for retrieving the modular charges from among the magazine tubes, the manipulator also altering the position of the at least one retrieval tube to be adjacent a loading mechanism of an artillery gun.

16. The device according to claim 15, wherein the loading mechanism of the artillery gun is fully automatic.

17. The device according to claim 15, wherein the loading mechanism of the artillery gun is semi-automatic.

18. The device according to claim 15, wherein the magazine tubes are all parallel to each other.

19. The device according to claim 18, wherein each magazine tube is arranged adjacent at least one other magazine tube.

20. The device according to claim 18, wherein all of the magazine tubes terminate in a common end plane.

21. The device according to claim 15, wherein some of the modular charges have different characteristics than other of the modular charges wherein the characteristics include at least one member selected from the group consisting of different types of propellant, lengths, diameters and strengths.

22. The device according to claim 21, wherein a muzzle velocity of the artillery gun may be varied by varying the number and characteristics of the modular charges retrieved from the magazine tubes.

23. The device according to claim 15, wherein the modular charges are modular artillery charges.

24. The device according to claim 15, wherein the modular charges include a substantially rigid combustible outer casing.

25. The device according to claim 15, wherein the modular charges are linearly stored in the magazine tubes.

26. The device according to claim 15, wherein the loading mechanism comprises a loading tray and a loading pendulum.

27. The device according to claim 15, wherein the manipulator alters the position of the at least one retrieval tube in a plurality of directions.

28. The device according to claim, 27, wherein the manipulator alters the position of the at least one retrieval tube in an x-direction, a y-direction, and diagonally.

29. The device according to claim 15, wherein the manipulator comprises a plurality of arms and a plurality of journaled joints.

30. The device according to claim 15, wherein the magazine tubes terminate in a common end plate and the manipulator comprises at least two mutually perpendicular feed slides in a plane parallel to the common endplane of the magazine tubes.

31. The device according to claim 15, further comprising:

a plurality of retrieval tubes.

32. The device according to claim 31, wherein the manipulator supports the plurality of retrieval tubes that each can be filled with modular charges prior to firing from the artillery gun a number of projectiles in rapid succession, during the firing the retrieval tubes are sequentially positioned behind a loading pendulum of the loading mechanism of the artillery gun to provide the complete propellant charges for the projectiles being fired.

33. The device according to claim 31, further comprising:

at least one ejector for ejecting the modular propellant charges from the at least one retrieval tube.

34. The device according to claim 33, wherein each retrieval tube includes its own ejector.

35. The device according to claim 34, wherein the retrieval tube ejectors are adjustable between different positions depending on the number of modular charges to be retrieved from each magazine tube.

36. The device according to claim 15, further comprising: wherein the ejectors utilize compressed air to eject the modular charges from the magazine tubes.

37. The device according to claim 15, wherein the plurality of magazine tubes are provided in two magazine units, the at least one retrieval tube is arranged to pivot between the two magazine units such that the at least one retrieval tube can receive the modular charges from the magazine tubes of both magazine units, the retrieval tube receives the modular charges from at least one of the front of the retrieval tube or the rear of the retrieval tube.

38. The device according to claim 15, further comprising:

at least one ejector for ejecting the modular propellant charges from the at least one retrieval tube, wherein the plurality of magazine tubes are provided in two magazine units, the at least one retrieval tube is arranged to pivot between the two magazine units such that the at least one retrieval tube can receive the modular charges from the magazine tubes of both magazine units, the retrieval tube receives the modular charges from at least one of the front of the retrieval tube or the rear of the retrieval tube.

39. The device according to claim 15, further comprising: an armored turret for housing the magazine tubes, the at least one retrieval tube, and the manipulator.

40. The device according to claim 39, wherein the armored turret includes an inclined side wall.

41. The device according to claim 40, wherein the plurality of magazine tubes are arranged in the vicinity of the inclined side wall of the armored turret and a portion of the magazine tubes are arranged adjacent the inclined side wall.

42. The device according to claim 15, further comprising:

a plurality of outfeed catches provided at the outfeed apertures of the magazine tubes.

43. The device according to claim 42, wherein one outfeed catch is arranged at the outfeed aperture of each magazine tube.

44. The device according to claim 42, wherein a plurality of outfeed catches are arranged at the outfeed aperture of each magazine tube.

45. The device according to claim 15, wherein each modular charge includes an ignition system.

* * * * *